US005172668A

United States Patent [19]

Göhring et al.

[11] Patent Number: 5,172,668

[45] Date of Patent: Dec. 22, 1992

[54] LOAD ADJUSTMENT DEVICE FOR AN INTERNAL COMBUSTION ENGINE CONTROLLED BY THROTTLE VALVE

[75] Inventors: Frank Göhring, Frankfurt; Erwin Schneider, Liederbach, both of Fed. Rep. of Germany

[73] Assignee: VDO Adolf Schindling AG, Frankfurt am Main, Fed. Rep. of Germany

[21] Appl. No.: 818,756

[22] Filed: Jan. 9, 1992

[30] Foreign Application Priority Data

Jan. 9, 1991 [DE] Fed. Rep. of Germany ..... 4100381

[51] Int. Cl.[5] ..... F02D 9/02; F02D 11/02

[52] U.S. Cl. ..... 123/399; 123/400

[58] Field of Search ..... 123/361, 399, 400

[56] References Cited

U.S. PATENT DOCUMENTS

| | | | |
|---|---|---|---|
| 4,519,361 | 5/1985 | Murakami | 123/399 |
| 4,523,565 | 6/1985 | Omitsu | 123/399 |
| 4,785,782 | 11/1988 | Tanaka et al. | 123/399 |
| 4,848,297 | 7/1989 | Hickmann et al. | 123/399 X |
| 4,873,957 | 10/1989 | Ueyama et al. | 123/399 |
| 4,922,177 | 5/1990 | Mausner | 123/399 X |
| 4,953,529 | 9/1990 | Pfalzgraf et al. | 123/399 X |
| 5,014,666 | 5/1991 | Westenberger | 123/399 X |
| 5,038,733 | 8/1991 | Westenberger | 123/399 X |
| 5,065,721 | 11/1991 | Wiggins et al. | 123/399 |
| 5,076,232 | 12/1991 | Pfalzgraf et al. | 123/399 |

*Primary Examiner*—Willis R. Wolfe
*Attorney, Agent, or Firm*—Martin A. Farber

[57] ABSTRACT

A load adjustment device for an internal combustion engine includes a throttle valve (4) which can be acted on via a the setting element (8) on the accelerator-pedal side and, also by an electromotive setting drive (12), their movements being decoupled. In order to be able to note both the idle position of the setting element (8) and a driver's wish for "idle" and, furthermore, the actual position value of the electromotive setting drive (12) for a position control circuit and the throttle-valve position for injection electronics, there is a drive potentiometer (25) associated with the electromotive setting drive (12). Also a throttle-valve potentiometer (24) is associated with the throttle valve (4). The drive (12) and the potentiometer (24) have a common support plate (19) which is fastened, fixed for rotation, to the drive shaft (11) of the electromotive setting drive (12). There are two wiper paths (21, 20), a wiper (21) for the drive potentiometer (25) being arranged fixed on the housing and a wiper (20) for the throttle-valve potentiometer (24) fastened, fixed for rotation, to a further setting element on the throttle-valve side. The further setting element is developed as throttle-valve shaft (5). Alternatively the two potentiometers may be provided with different support plates, one plate operating with the electromotive setting drive and the other plate operating with the accelerator setting element.

6 Claims, 3 Drawing Sheets

LOAD ADJUSTMENT DEVICE FOR AN INTERNAL COMBUSTION ENGINE CONTROLLED BY THROTTLE VALVE

FIELD AND BACKGROUND OF THE INVENTION

The present invention relates to a load adjustment device for an internal combustion engine which is controlled by throttle valve, wherein the throttle valve is urged in the downward control direction. Furthermore, a setting element which can be set in full-load direction by means of the accelerator pedal, and is urged in downward control direction against an idle stop into a position $LL_{min}$, engages in upward-control direction into a path of movement of a setting element for the throttle valve. Also, a setting element which can be controlled by an electromotive setting drive, and is urged in downward control direction, engages in upward control direction into the path of movement of the setting element for the throttle valve. The load-adjustment device also includes means which detect the position of the throttle valve and the position of the setting element on the setting-drive side as well as the $LL_{min}$ position of the setting element on the accelerator-pedal side.

Such a load adjustment device serves the purpose of adjusting the throttle valve in idle operation and/or permitting speed control in the partial-load/full-load region of the internal combustion engine via an electromotive setting drive independently of the accelerator pedal. In the load-adjustment device, the following signals are to be detected in order to effect the control:

1. detection of the driver's wish for "idle",
2. value of the actual position of the electromotive setting drive for the position control circuit,
3. the throttle-valve position for the injection electronics.

Heretofore these functions have been realized by an idle contact on a setting element on the accelerator-pedal side developed as a pulley, as well as a first potentiometer on a drive shaft of the electromotive setting drive, and a second potentiometer on the setting element on a throttle-valve side developed as throttle-valve shaft. The wiper paths of both potentiometers are present on a common support plate which is rigidly connected to the throttle-valve housing. The wipers are moved relative to the wiper path by the electromotive setting drive or the throttle valve.

SUMMARY OF THE INVENTION

It is an object of the present invention to develop a load adjustment device of the foregoing type such that, without a separate idle contact associated with the setting element on the accelerator-pedal side, the driver's wish for "idle" can be detected and, in addition, every operating position of the throttle valve and of the electromotive setting drive can be detected.

According to the invention, the means for detecting the position of the foregoing parts is developed as drive potentiometer (25) and throttle-valve potentiometer (24), which poteniometers have a common support plate (19) which is fastened, fixed for rotatoon, to a drive shaft (11) of an electromotive setting drive (12). There are has two wiper paths (21, 20), one wiper (21) for the drive potentiometer (25) fixed on the housing and one wiper (20) for the throttle-valve potentiometer (24) fastened, fixed for rotation, to the setting element on the throttle-valve side, the latter being developed as throttle-valve shaft (5).

If the throttle valve is moved via the electromotive setting drive, no relative movement takes place between the wiper attached to the throttle-valve shaft and the associated wiper path. If the accelerator pedal is actuated, then the throttle valve moves relative to the electromotive setting drive. On the wiper attached to the throttle-valve shaft a voltage jump is measured which indicates that the $LL_{min}$ (minimum idle speed) position has been left. The injection electronics receive as input signal the sum of the two voltage jumps of electromotive setting drive and throttle-valve shaft.

According to a feature of the invention, the setting element (8) on the accelerator-pedal side is developed as a pulley (8*a*), (8*b*) and the axes of rotation of the throttle-valve shaft (5), drive shaft (11) of the electromotive setting drive (12) and pulley are aligned with each other.

Also according to an embodiment the invention shown in FIG. 4, it is proposed that the device for detecting the position of the parts be developed as drive potentiometer (25) and as potentiometer (29) associated with the setting element (8) on the accelerator-pedal side. A first support plate (19) is fastened to the housing and is provided with a wiper path (21) with which a wiper (22), attached fixed for rotation to the drive shaft (11) of the electromotive setting drive (12), cooperates. A second support plate (26) is fastened to the housing, and is provided with a wiper path (27) with which there cooperates a wiper (28), the wiper (28) being fastened, fixed for rotation, to a setting element on the accelerator-pedal side, and is developed as swingable part (8).

The swingable part (8) is, in particular, a pulley.

In the position $LL_{min}$, the pulley remains at rest so that a constant, well-defined voltage is tapped off from the wiper associated with it. A change in voltage indicates that the idle position has been left. Since the throttle valve is always moved either by the pulley or by the electromotive setting drive, the injection electronics in each case receives the higher of the two voltage values of the two potentiometers.

According to another feature of the invention, the throttle valve (4) is mounted in a throttle-valve shaft (5) and the axes of rotation of throttle-valve shaft (5), drive shaft (11) of the electromotive setting drive (12) and the pulley (8) are aligned with each other.

BRIEF DESCRIPTION OF THE DRAWING

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
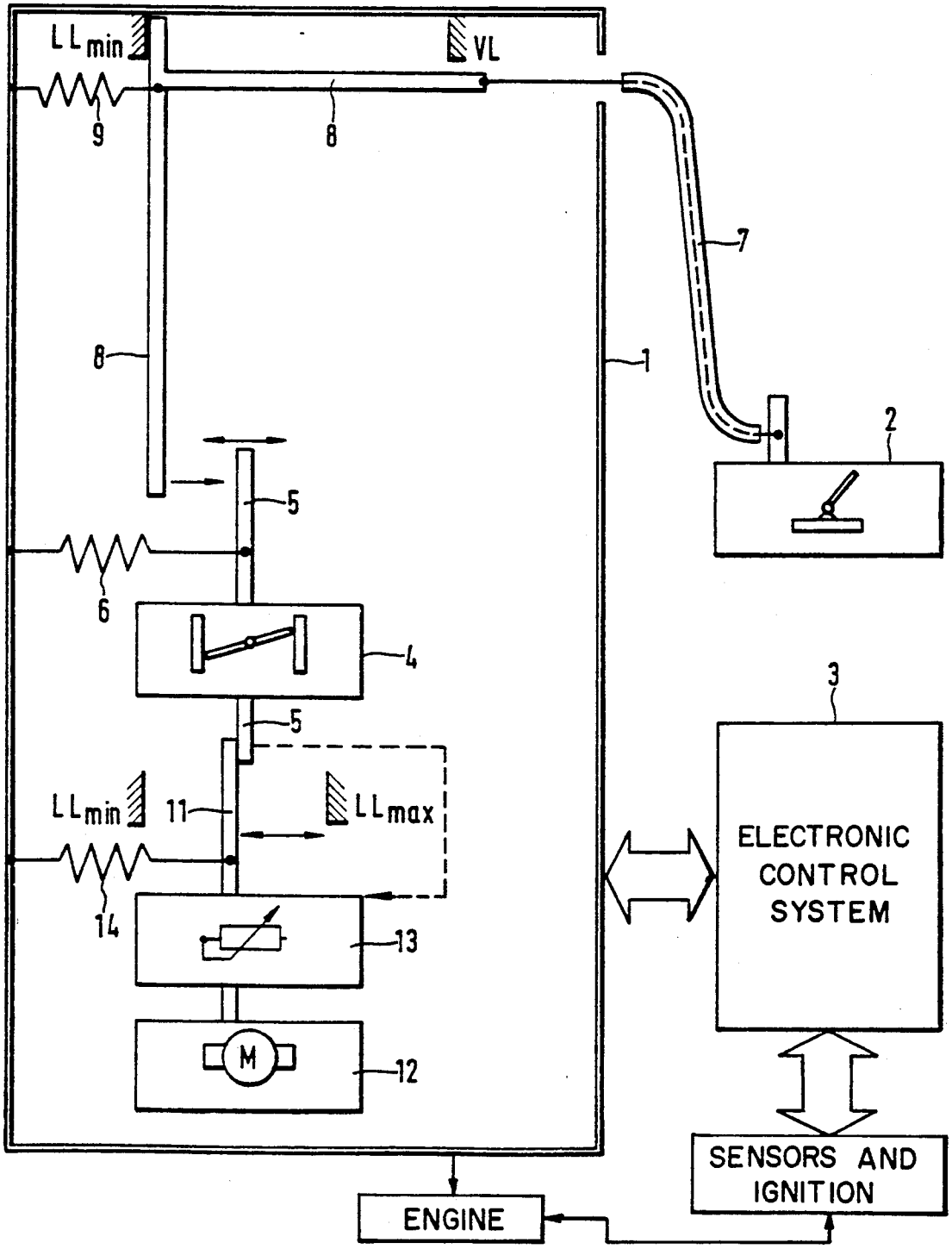
FIG. 1 is a block diagram showing the basic manner of action of a load adjustment device operating in the idle control range, in accordance with the first embodiment of the invention.

FIG. 1 refers to the case of the electromotive control of the throttle valve in the idling range of the internal combustion engine. In this figure, 1 designates a load adjustment device which can be controlled externally via an accelerator pedal 2 and an electronic system 3. The load adjustment device 1 contains the throttle valve 4, which can be displaced via a setting element (throttle-valve shaft) 5 on the throttle-valve side. A tension spring 6 acts on the setting element 5 on the throttle-valve side and on a stationary part of the load adjustment device 1 and urges the setting element 5 on the throttle-valve side in the idle direction.

The throttle valve 4 is adjustable between a minimum idle position $LL_{min}$ and a full-load position VL.

The accelerator pedal 2 cooperates via a Bowden cable 7 with a setting element 8 on the accelerator-pedal side, which setting element is movable by the accelerator pedal 2 between a stop $LL_{min}$ and a stop VL. A tension spring 9 acts on the setting element 8 on the accelerator-pedal side and on a stationary part of the load adjustment device 1, and urges the setting element 8 on the accelerator-pedal side in idle direction against the stop $LL_{min}$.

The setting element 8 on the accelerator-pedal side engages in upward-control direction into the path of movement of the setting element 5 on the throttle-valve side. Independently of this, the setting element 11 on the setting-drive side engages in upward-control direction into the path of movement of the setting element 5 on the throttle-valve side. The setting element 11 on the setting-drive side is movable by means of an electromotive setting drive 12 between a stop $LL_{min}$ and a stop $LL_{max}$. A tension spring 14 acts on the setting element 11 on the setting-drive side and on a stationary part of the load adjustment device 1 and urges the setting element 11 on the setting-drive side in downward-control direction against the stop $LL_{min}$.

The load adjustment device described above is controlled in the idle control range via the electromotive setting drive 12 and in partial-load operation as well as full-load operation via the accelerator pedal 2. In idle operation—with the accelerator pedal 2 not actuated—the setting element 8 on the accelerator-pedal side assumes the stop position $LL_{min}$ shown in the drawing. Concurrently, the throttle valve 4 operates as a function of the control via the electromotive setting drive 11 which in its turn is controlled by the electronics system 3. The valve 4 is at an operating point which, in the example of FIG. 1, lies approximately in the center between the operating positions $LL_{min}$ and $LL_{max}$. This operating point can, of course, vary; it depends, for example, on the operating temperature and the loads (for instance rear-window heater, air conditioner) which must be supplied by the internal combustion engine and, thus, cause a certain variable need for air on the part of the internal combustion engine.

Figure 2A:
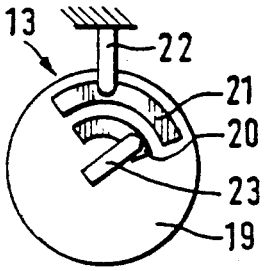
FIG. 2*a* is a view in accordance with FIG. 2 of the potentiometers used there in the region of the electromotive setting drive.
Figure 2:
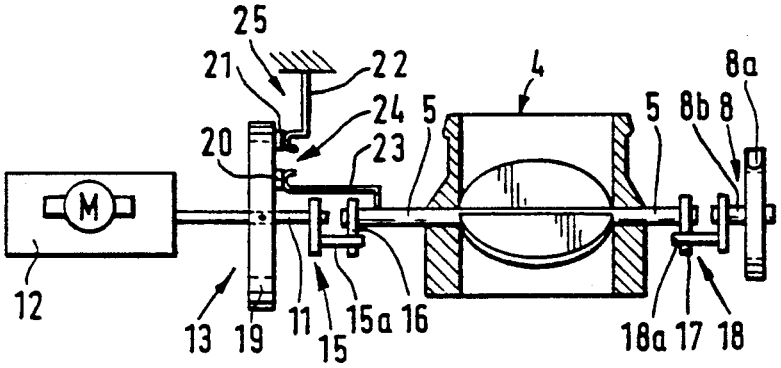
FIG. 2 is a diagrammatic showing of the load adjustment device of FIG. 1 in the region of throttle valve, accelerator-pedal side setting element, and electromotive setting drive.

The positions of the setting element 11 on the setting-drive side and of the setting element 5 on the throttle-valve side are monitored by means of an actual-value detection element 13 associated essentially with the setting element 5 on the setting-drive side, the arrangement and manner of operation of which element is shown in further detail in FIGS. 2 and 2a.

FIG. 2 shows that the electromotive setting element 11 is developed as drive shaft of the setting motor 12, the free end of which has a driver 15, the driver extension 15a of which is arranged eccentric to the drive shaft 11. Furthermore, the setting element 5 on the throttle-valve side is developed as throttle-valve shaft, each of the two ends of the throttle-valve shaft 5 receiving a radially extending driver 16, 17 respectively. The throttle-valve shaft 5 is aligned with the drive shaft 11 of the electromotive setting drive 12 and is slightly spaced from it, the driver extension 15a engaging behind the driver 16 in the upward-control direction. Finally, the setting element 8 on the accelerator-pedal side is developed as pulley which consists of the actual pulley element 8a and the pulley shaft 8b attached centrally to it. Corresponding to the driver 15, a driver 18 is attached, fixed for rotation, to the pulley shaft 8b and has a driver extension 18a arranged eccentric to the pulley shaft 8b. The pulley shaft 8b is aligned with the throttle-valve shaft 5 and is slightly spaced from it. The driver extension 18b engages behind the driver 17 in the upward-control direction. The pulley element 8a can be acted on in upward-control direction by means of the Bowden cable 7 on the pedal side.

The actual-value detection element 13, which is associated essentially with the drive shaft 11 of the electromotive setting drive 12, has a support plate 19 which is attached, fixed for rotation, to the drive shaft 11 and which, as can be noted in particular from FIG. 2a, has two wiper paths 20 and 21 on the side facing the throttle valve 4, each extending over approximately a quarter of a circle. With the outer wiper path 21 there cooperates a wiper 22 which is mounted fixed in position, in particular fixed to the housing, either on the throttle-valve housing or on the housing of the load adjustment device. With the inner wiper path 20 there cooperates a wiper 23 which is fastened, fixed for rotation to the region of the throttle-valve shaft 5 facing the drive shaft 11.

If the electromotive setting drive 12 moves the throttle valve 4 via the driver 15, no relative movement takes place between the wiper 23 and the wiper path 20. If the pulley 8 is actuated, then the throttle valve 4 is moved via the driver 18 relative to the electromotive setting drive 12 and thus the support plate 19. In the region of the potentiometer 24 formed by the wiper 23 and the wiper path 20, a voltage jump is measured which indicates that the $LL_{min}$ position has been left. Upon a movement of the electromotive setting drive 12, a voltage jump is measured by the further potentiometer 25 formed by the wiper 22 and the wiper path 21, which voltage jump indicates the position of the electromotive setting drive 12. The injection electronics, which is part of the electronic system 3, receives as input signal the sum of the two voltage jumps of electromotive setting drive 12 and throttle valve 4.

Figure 3:
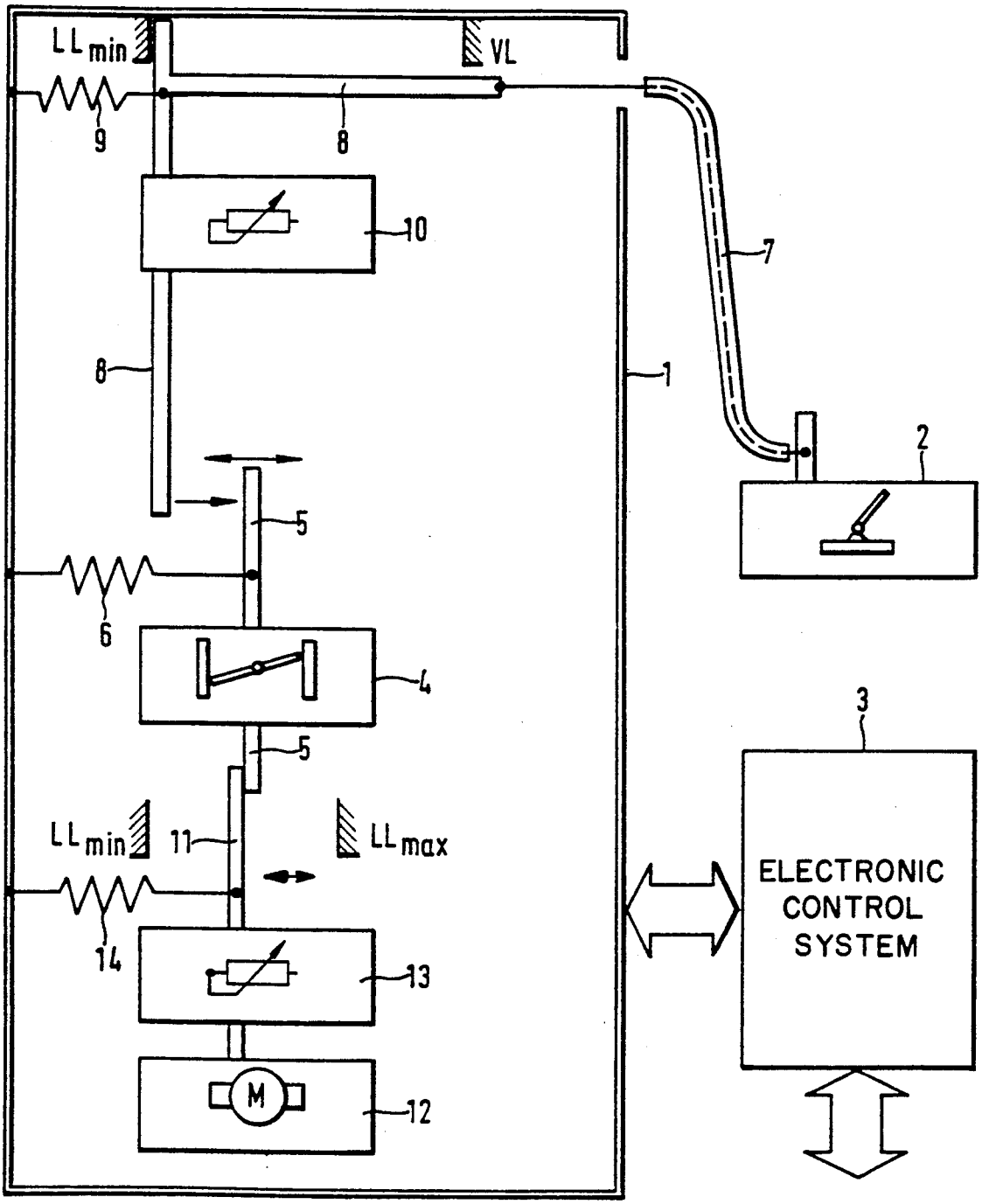
FIG. 3 is a block diagram according to FIG. 1 for a load adjustment device serving for adjustment of idle and speed in accordance with the second embodiment of the invention.

The load adjustment device shown in FIG. 3 is modified as compared with the load adjustment device described in FIG. 1 only with regard to the detection of the actual values. Parts corresponding therewith have for the sake of simplicity been provided with the same reference numerals.

From the block diagram of FIG. 3 it can be noted that an actual-value detection element 13 is associated with the electromotive setting drive 12 and that a separate actual-value detection element 10 is associated with the setting element 8 on the pedal side. In this variant, the actual value of the setting element 5 on the throttle-valve side is thus indirectly indicated. The variant of FIG. 3 differs from that of FIG. 1 in the manner that the electromotive setting drive 12 does not serve exclusively for adjusting the throttle valve 4 in the idle control range, but also for regulating the speed in a range from $LL_{min}$ to VL. Details of the detection of the position of the setting element 11 on the setting-drive side and of the setting element 8 on the accelerator-pedal side can be noted from FIG. 4; parts agreeing with the variant of FIG. 2 have been provided with the same reference numerals.

Figure 4:
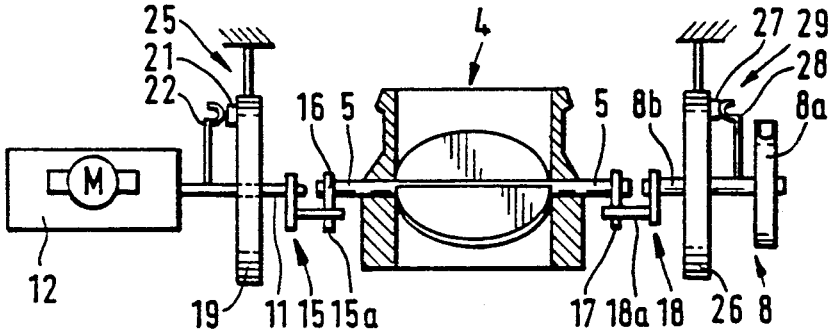
FIG. 4 is a diagrammatic showing in accordance with FIG. 3 for the load adjustment device in accordance with the second embodiment of the invention.

As can be noted from FIG. 4, the drive shaft 11 of the electromotive setting drive 12, the throttle-valve shaft 5 and the pulley shaft **8*b* are aligned with each other. The support plate 19 is not attached, fixed for rotation, to the drive shaft 11, but the drive shaft 11 passes through a hole in the support plate 19, the plate 19 being firmly attached to the housing. On the side facing the electromotive setting drive 12, the support plate 19 is provided with the wiper path 21, and the wiper 22 which cooperates with said path is attached, fixed for rotation, to the drive shaft 11 in the variant shown in FIG. 4. Accordingly, the pulley shaft 8*b* passes through a cut-out in another support plate 26, which, like the support plate 19, is arranged fixed to the housing in this variant. On the side facing the pulley element 8*a*, the support plate 26 has a wiper path 27 which cooperates with a wiper 28 which is attached, fixed for rotation, to the drive shaft 8*b*. Upon idle, the pulley 8 remains at rest so that a constant, well-defined voltage is tapped off by the potentiometer 29 formed by the wiper path 27 and the wiper 28. A change in voltage indicates that the idle position of the pulley 8 has been left. Via the potentiometer 25 formed by the wiper path 21 and the wiper 22, the position of the electromotive setting drive 12 is indicated. Since the throttle valve 4 is always moved either by the pulley 8 or by the electromotive setting drive 12, the injection electronics in each case receives the higher of the two voltage values of the two potentiometers 25 and 29**.

Of course, the variant of FIG. 2 can also be used in connection with the load adjustment devices of FIG. 3 which cover the idle control range and the speed control, in the same way as conversely the variant of FIG. 4 can be used with the load adjustment device of FIG. 1.

We claim:

1. A load adjustment device for an internal combustion engine which is controlled by throttle valve, the throttle valve being urged in a downward control direction, the adjustment device comprising a housing, an acceleration pedal, an idle stop, a first setting element, and a second setting element, the first setting element being settable in full-load direction by means of the accelerator pedal and being urged in downward control direction against the idle stop into a minimum idle speed position $LL_{min}$, the throttle valve engaging in upward-control direction into a path of movement of the second setting element;

an electromotive setting drive, the second setting element being controlled by the electromotive setting drive and, upon being urged in downward control direction, engages during upward control direction into the path of movement of the first setting element;

means for detecting a position of the throttle valve and of the second setting element, and the $LL_{min}$ position of the first setting element;

wherein said detecting means comprises a drive potentiometer having a first wiper, a throttle-valve potentiometer having a second wiper, a common support plate for both of said potentiometers;

said load adjustment device comprises a drive shaft connecting with said electromotive setting drive, said common support plate being fastened, fixed for rotation, to said first drive shaft, and having a first potentiometer wiper path and a second potentiometer wiper path;

wherein said first wiper is arranged fixed on said housing and said second wiper is fastened, fixed for rotation, to said second setting element, said second setting element comprising a throttle-valve shaft.

2. A load adjustment device according to claim 1, wherein said first setting element is formed as a pulley; and the axes of rotation of said throttle-valve shaft, said drive shaft of the electromotive setting drive, and said pulley are aligned with each other.

3. A load adjustment device for an internal combustion engine which is controlled by throttle valve, the throttle valve being urged in a downward control direction, the adjustment device comprising a housing, an acceleration pedal, an idle stop, a first setting element, and a second setting element, the first setting element being settable in full-load direction by means of the accelerator pedal and being urged in downward control direction against the idle stop into a minimum idle speed position $LL_{min}$, the throttle valve engaging in upward-control direction into a path of movement of the second setting element;

an electromotive setting drive, the second setting element being controlled by the electromotive setting drive and, upon being urged in downward control direction, engages during upward control direction into the path of movement of the first setting element;

means for detecting a position of the throttle valve and of the second setting element, and the $LL_{min}$ position of the first setting element; and wherein said detecting means comprises a drive potentiometer and an acceleration potentiometer operatively coupled with said first setting element;

a first support plate which is fastened to said housing and has a potentiometer wiper path operative with a first wiper, said first wiper being part of said accelerator potentiometer and being fastened, fixed for rotation, to said first setting element, said first setting element comprising a swingable part; and a second support plate which is fastened to said housing and has a potentiometer wiper path operative with a second wiper attached fixed for rotation to a drive shaft of said electromotive setting drive, said second wiper being part of said drive potentiometer.

4. A load adjustment device according to claim 3, wherein the swingable part comprises a pulley.

5. A load adjustment device according to claim 4, further comprising a throttle valve shaft, said throttle valve being mounted on said throttle-valve shaft;

wherein the axes of rotation of said throttle-valve shaft, said drive shaft of the electromotive setting drive, and said swingable part of said first setting element are aligned with each other.

6. A load adjustment device according to claim 3, further comprising a throttle valve shaft, said throttle valve being mounted on said throttle-valve shaft;

wherein the axes of rotation of said throttle-valve shaft, said drive shaft of the electromotive setting drive, and said swingable part of said first setting element are aligned with each other.

* * * * *